United States Patent [19]

Potter

[11] Patent Number: 4,553,359

[45] Date of Patent: Nov. 19, 1985

[54] CONVERTIBLE RESTAURANT SEATING

[76] Inventor: Robert S. Potter, 661 N. 50th St., Omaha, Nebr. 68132

[21] Appl. No.: 534,482

[22] Filed: Sep. 21, 1983

[51] Int. Cl.[4] ..... E04H 3/00

[52] U.S. Cl. ..... 52/173 R; 52/33; 52/29; 52/239; 52/39; 297/158; 297/157; 108/60

[58] Field of Search ..... 52/33, 29, 6, 7, 238.1, 52/239, 243.1, 173 R, 64, 39, 125.2; 160/134, 330; 297/184, 158, 157; 105/327, 323, 324; 108/60

[56] References Cited

U.S. PATENT DOCUMENTS

| | | | |
|---|---|---|---|
| 3,083,417 | 4/1963 | Cook | 52/125.2 X |
| 3,266,204 | 8/1966 | Andrews | 297/158 |
| 3,780,479 | 12/1973 | Billarant | 52/DIG. 13 |
| 3,882,921 | 5/1975 | Sandall | 160/290 R X |
| 4,317,480 | 3/1982 | Phelps | 160/290 X |

FOREIGN PATENT DOCUMENTS

| | | | |
|---|---|---|---|
| 2916290 | 10/1980 | Fed. Rep. of Germany | 52/29 |

*Primary Examiner*—Henry E. Raduazo
*Assistant Examiner*—Caroline Dennison
*Attorney, Agent, or Firm*—George R. Nimmer

[57] ABSTRACT

A prior art type of restaurant seating includes a longitudinal row of laterally extending consecutive seating stations delineated by and individually accessible from parallel longitudinal aisles. The invention herein discloses means for additionally employing such prior art restaurant seating in a condition where an individual seating station might be temporarily converted into a pair of laterally shorter seating zones to accommodate two small dining groups in a private and aesthetic setting. The convertible restaurant seating includes an upright partition extending medially longitudinally through the row of seating stations, the partition having a view-way in lateral registry with each consecutive dining table and which view-way can be temporarily closed-off with apt closure means.

3 Claims, 6 Drawing Figures

CONVERTIBLE RESTAURANT SEATING

BACKGROUND OF THE INVENTION

Drawing FIGS. 1 and 2 are top plan and side elevational views, respectively, of a typical prior art restaurant installation (SN) representing an axially longitudinal (CC) row of consecutive seating stations (e.g. S1, S2, S3, etc.). The row seatings (SN) is laterally delineated by leftward (AL) and rightward (AR) parallel aisles of the restaurant flooring (G) whereby each seating station has a finite lateral-width (FW) therebetween. Respective seating stations comprise three laterally extending components which extend uprightly from the flooring (G) and including a pair of facing bench means and an intervening table having tabletop surface (TT) and elevating legs (e.g. TL, TR). In the typical installation SN, the bench means comprises terminally positioned half-benches B1 and B4 and two full-benches B2 and B3. Thus: seating station S1 is defined by half-bench B1, table T1, and part of full-bench B2; seating station S2 is defined by parts of full-benches B2 and B3 and table T2; and seating station S3 is defined by part of full-bench B3, table T3, and half-bench B4.

Because of the presence of the two aisles (AL, AR), such prior art installations (SN) are customarily designed of sufficient lateral-width (FW) whereby each seating station might accommodate a relatively large dining party e.g. five to eight persons. However, if the mix of diners awaiting seating accommodations includes an unexpected number of smaller parties e.g. four or fewer persons, it would be wasteful for the restaurateur to permit such smaller dining party to occupy an entire (FW) seating station. On the other hand, any attempt by the restaurateur to make full use of the entire seating station by assigning two smaller dining parties thereto is apt to be met with resentment at their being forced to share the same dining table with strangers.

OBJECT OF THE INVENTION

It is accordingly the main objective of the present invention to provide, for a longitudinal row of consecutive seating stations delineated by parallel aisles, means for temporarily converting one or more of the individual seating stations into two closed-off subparts whereby the seating station might be temporarily utilized for accommodating two smaller dining parties in mutually private and aesthetically attractive atmospheres.

GENERAL DESCRIPTION OF THE INVENTION

With the aforestated main objective in view, and together with other specific objectives which will become more apparent as this description proceeds, the convertible restaurant seating of the present invention generally comprises: partition means extending uprightly from the restaurant flooring and dividing the benches means and tables components of seating stations into leftward and rightward seating zones, the partition means in lateral registry with respective tables being provided with a view-way; uprightly extending closure means for the respective view-ways and being removably attachable with the suitable fastener means to the partition means; and together with optional sophisticated embodiments and forms for the partition and closure means that make the convertible restaurant seating particularly adaptable for the intended purposes.

BRIEF DESCRIPTION OF THE DRAWINGS

In the drawing, wherein like characters refer to like parts in the several views, and in which.

DETAILED DESCRIPTION OF THE DRAWINGS

Figure 2:
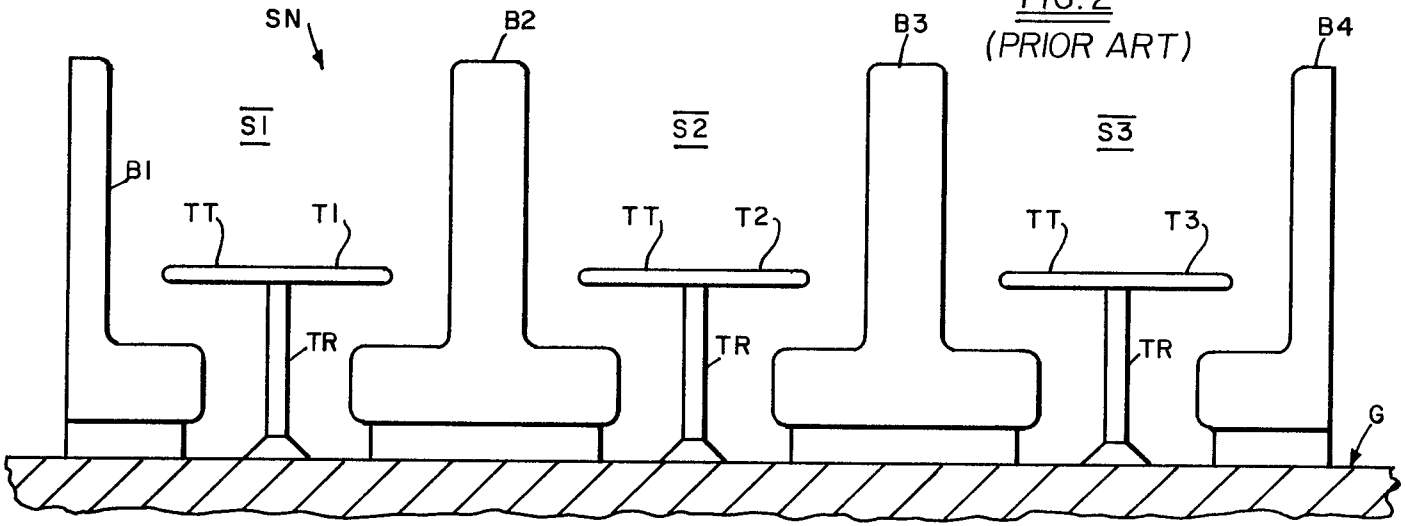
FIG. 2 (PRIOR ART)
FIG. 2 is a side elevational view of the FIG. 1 prior art installation taken along lines 2—2 of FIG. 1.
Figure 3:
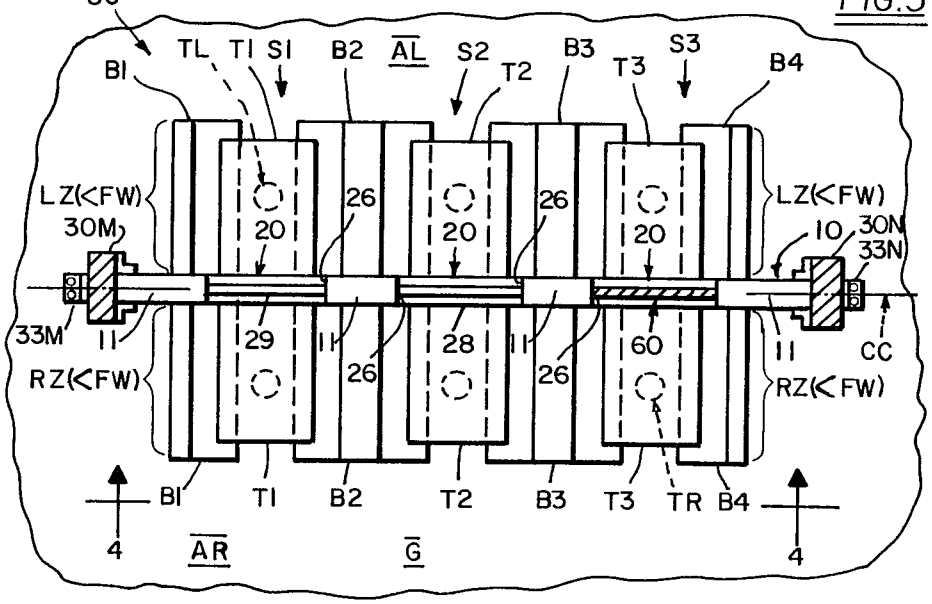
FIG. 3 is a top plan view akin to FIG. 1 of a representative embodiment of the convertible restaurant seating of the present invention taken along line 3—3 of FIG. 4.
Figure 1:
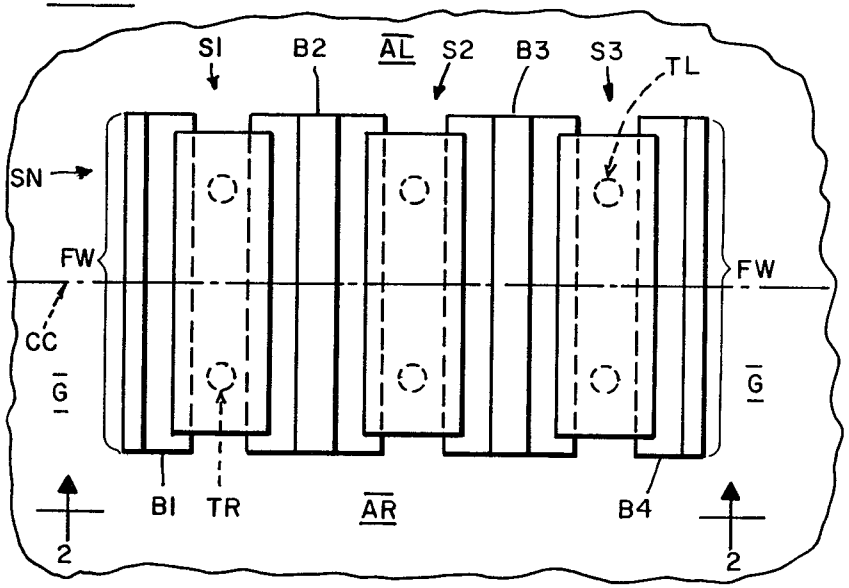
FIG. 1 (PRIOR ART)
FIG. 1 is a top plan view of a typical prior art restaurant seating installation representing an axially longitudinal row of consecutive seating stations accessible from two parallel aisles.
Figure 5:
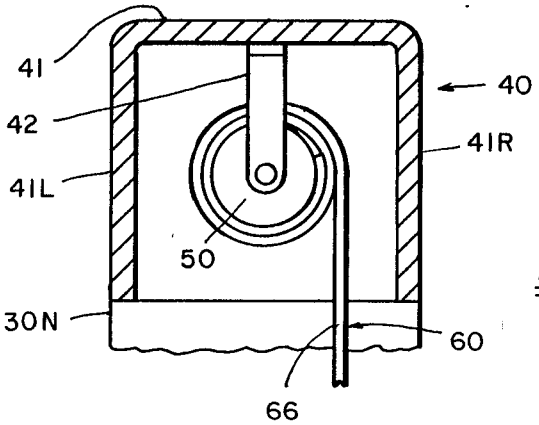
FIG. 5 is a detail sectional elevational view taken along line 5—5 of FIG. 4.
Figure 4:
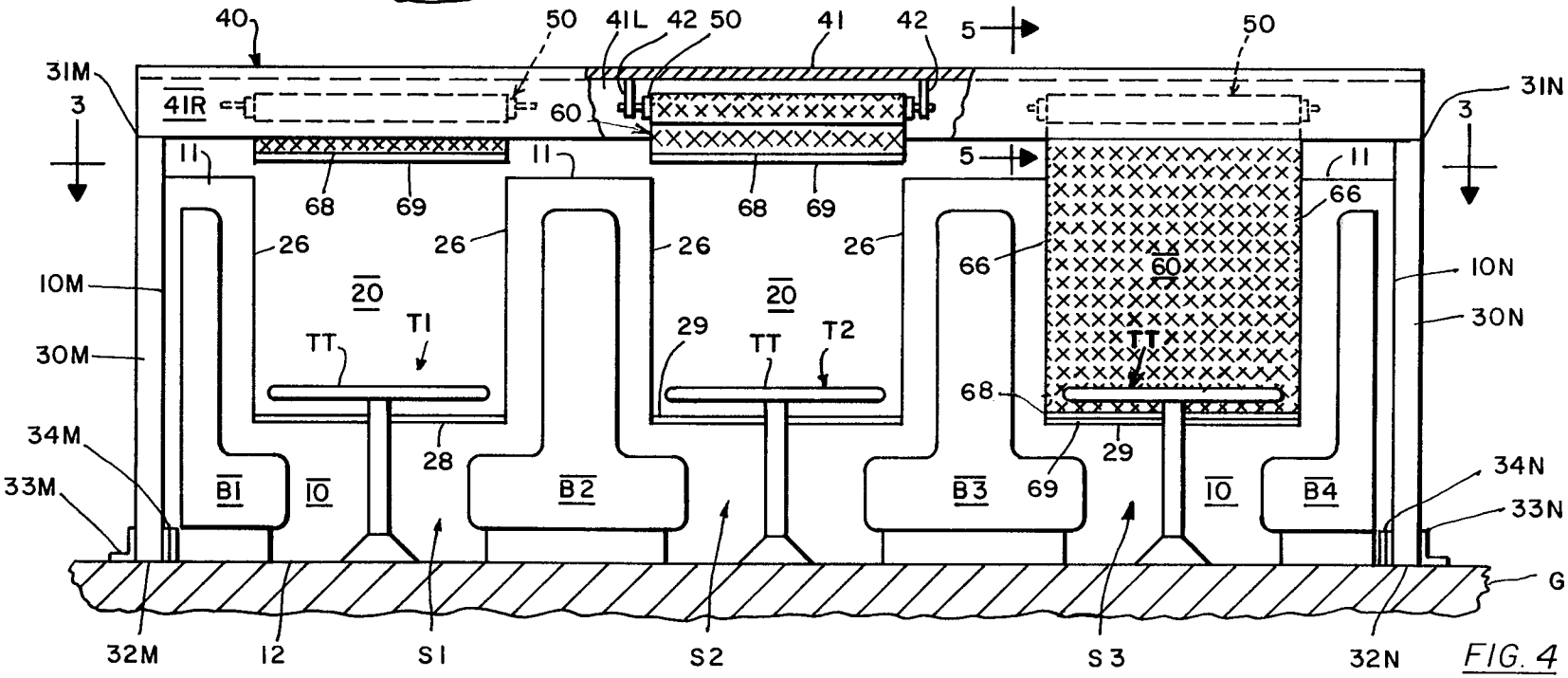
FIG. 4 is a side elevational view akin to FIG. 2 and taken along line 4—4 of FIG. 3.

Prior art seating installation SN of drawing FIGS. 1 and 2 might be modified into the convertible restaurant seating style SC of drawing FIGS. 3–5 by employing a partition means provided with strategically positioned view-ways (20). The partition means extends uprightly from the restaurant flooring G and along a vertical-plane at the seating longitudinal-axis CC. Thus, the partition means physically divides the benches means and table components of seating stations into laterally extending and preferably substantially equal sub-parts of lateral-width FW i.e. leftward and rightward seating zones LZ and RZ. The partition means, in lateral registry with respective seating stations at the table component, is provided with view-ways 20.

A representative embodiment partition means comprises a preferably opaque wall panel 10, such as plywood or the like, of generally rectangular shape including vertically extending first-edge 10M and second-edge 10N, a longitudinally extending horizontal lower-edge 12 adapted to rest upon flooring G, and a longitudinally extending horizontal upper-edge 11 located in elevation above the tabletops TT. For embodiment SC, panel upper-edge 11 is located above the benches means B1, B2, B3, and B4. In lateral registry with tables T1, T2, T3, etc., upright panel 10 is provided with view-ways 20 extending downwardly from panel upper-edge 11 and terminating therebelow as a base-edge located in elevation below the tabletops TT. View-way embodiment 20 comprises a horizontal base-edge 28 and a pair of parallel vertical-edges. 26.

There are uprightly extending non-transparent closure means for the respective view-ways (20) whereby individual seating stations (S1, S2, S3, etc.) are convertible between full lateral-width FW for a larger dining group and two closed-off sub-parts (LZ, RZ) for one or two smaller dining groups. Various closure means might be employed such as shutters, vertical-slats and horizontal-slats venitian blinds, accordian-type closures, curtains, rolled sheeting, etc. An especially desireable type closure means is of the rolled sheeting type, such as the embodiment comprising rollers 50 maintained in overlying relationship with respective view-ways 20 and obscured within a channeled horizontal beam 40.

Horizontal beam 40, having an inverted-U cross-sectional shape defined by roof-plate 41 and depending-plates 41L and 41R, has its two ends supported upon the upper-ends 31M and 31N of vertical columns 30. The lower-ends 32M and 32N of columns 30 rest upon flooring "G" and are attached thereto, such as with angle-irons 33M and 33N. Rollers 50 are revolvably secured within channeled beam 40 with hanger-fittings 42 depending from roof-plate 41. Each such elevated roller 50 is convolutely wrapped with flexible non-transparent sheeting 60 that is unwindably downwardly extendable from roller 50 to close-off partition view-way opening 20 therebelow. Sheeting 60 comprises a lineal horizontal leadward-border 68 and a pair of parallel lineal borders which function as vertical-borders whenever the sheeting is downwardly withdrawn from roller support 50.

Figure 6:
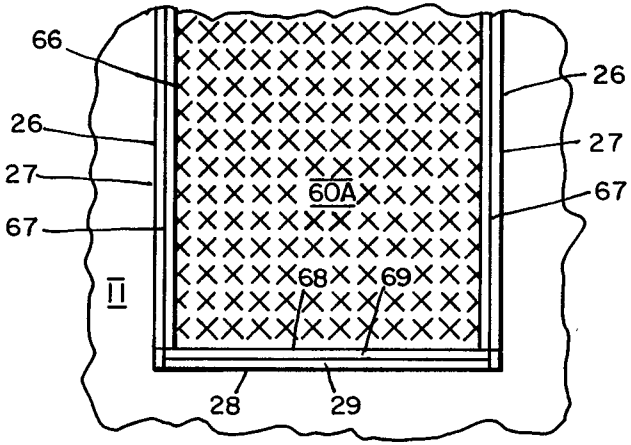
FIG. 6 is a detail elevational view of an alternate embodiment of the closeable partition view-way in closed-off condition.

There are appropriate fastener means for removably attaching the uprightly extending closure means in obscuring relationship across the partition means view-way openings. If such closure means be selected of the curtain-like flexible sheeting type e.g. 60, fastener means might take several forms such as hooks, snaps, zippers, etc. However, a preferred type fastener means is of the hooks-and-eyes "Velcro" type as described in U.S. Pat. No. 3,009,235. In this vein, one of the mateable "Velcro" strips (69) might be carried by sheeting leadward-border 68 and the other engageable "Velcro" strip (29) might be installed along viewway base-edge 28. Further, as alluded to in drawing FIG. 6, the curtain vertical-borders 66 and the view-ways vertical-edges 26 might also be provided with similarly mating pairs of "Velcro" strips (67, 27), thereby providing a more secure and aesthetically attractive removable attachment between the curtain closure and the partition. Toward the goal of attaining optimum privacy between the laterally aigned closed-off subparts (LZ, RZ) of each seating station, opaque closure means are preferred. For curtain type closures, those of heavy thickness e.g. quilted, facilitate the borderwise installation of "Velcro" strips 67 and 69 and to also act as an accoustical barrier between the subparts.

Though the convertible restaurant seating might be an original restaurant installation, a pre-existing prior art installation like that of FIGS. 1 and 2 might be readily modified to a convertible arrangement akin to SC of FIGS. 3 and 4. Such modification method comprises an early step of medially longitudinally slotting the entire existing installation (SN) along a verticalplane passing through longitudinal-axis CC. Then, upright columns 30M and 30N, having their lower ends 32M and 32N at flooring G, are anchored (e.g. 33M, 33N). The partition means (e.g. 10) is uprightly positioned within said medial longitudinal slot and then is uprightly anchored e.g. with brackets 34M, 34N. Thereafter the several closure means (e.g. 60, 60A. etc.) are installed in a condition whereby they might be employed for temporarily closing-off the partition view-way openings (20).

From the foregoing, the construction and operation of the convertible restaurant seating will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. In a restaurant environment including at least one row of plural seating stations extending uprightly from restaurant flooring and consecutively along a longitudinal-axis, said row being laterally delineated by leftward and rightward flooring aisles having a finite lateral-width therebetween, respective seating stations comprising three laterally extending components supported upon said flooring and including a pair of facing bench means and an intervening table with horizontal tabletop, the improvement wherein every one of said respective seating stations is individually convertible into selectable laterally extending widths of full and partial lateral-width whereby a seating station might be alternatively employed for a larger dining group utilizing full lateral-width and both aisles or two smaller dining groups utilizing closed-off subparts of the finite lateral-width and a single aisle, and said convertible restaurant seating comprising:

A. stationary partition means extending uprightly from the restaurant flooring and along a vertical-plane located substantially halfway between said flooring aisles whereby said partition means divides the benches means and tabletop components of every seating station into substantially equal leftward and righward laterally extending seating zones, said partition means having a longitudinally extending and fixed elevation upper-edge overlying the tabletops, and said partition means in lateral registry with every seating station at the tabletop component being provided with a cutout view-way extending downwardly from the partition upper-edge, each said partition view-way having a pair of parallel vertical-edges and a horizontal base-edge located below the tabletop;

B. a longitudinally extending and fixed elevation beam of inverted-U cross-sectional shape maintained in overlying relationship to all of said partition view-ways; and C. individually actuatable closure means for every one of the partition view-ways whereby individual seating stations are convertible by said closure means between full lateral-width for a larger dining group and two closed-off subparts of said lateral-width for two smaller dining groups, each said closure means comprising a longitudinally extending roller carried within said beam and overlying a partition view-way, said roller being convolutely wrapped with a flexible non-transparent sheeting material that may be temporarily downwardly withdrawn from the roller to close-off the partition view-way therebelow, and the sheeting in temporarily downwardly withdrawn condition comprising a pair of parallel vertical-borders lying contiguously along the view-way vertical-edges and further comprising a horizontal leadward-border lying contiguously along and including fastener means for removable attachment to the partition view-way base-edge.

2. The structure of claim 1 wherein the sheeting is opaque and relatively thick along the three borders thereof; and wherein the fastener means is of the hooks-and-eyes "Velcro" type and a portion of which is carried by at least one sheeting border.

3. The structure of claim 2 wherein the "Velcro" type fastener means is employed for removably attaching all three sheeting borders to all three view-way edges.

* * * * *